US011267266B2

(12) United States Patent
Hilton et al.

(10) Patent No.: US 11,267,266 B2
(45) Date of Patent: Mar. 8, 2022

(54) PRINT DUPLEXING ASSEMBLY WITH REMOVABLE DUPLEXING DEVICE

(71) Applicant: Hewlett-Packard Development Company, L.P., Houston, TX (US)

(72) Inventors: Michael Lee Hilton, Vancouver, WA (US); Allen Zandonatti, Tigard, WA (US); Paul Coffin, Battle Ground, WA (US); Daniel Fredrickson, Portland, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 930 days.

(21) Appl. No.: 16/065,354

(22) PCT Filed: Apr. 12, 2016

(86) PCT No.: PCT/US2016/027147
§ 371 (c)(1),
(2) Date: Jun. 22, 2018

(87) PCT Pub. No.: WO2017/180113
PCT Pub. Date: Oct. 19, 2017

(65) Prior Publication Data

US 2021/0206180 A1 Jul. 8, 2021

(51) Int. Cl.

| | |
|---|---|
| ***B41J 13/00*** | (2006.01) |
| ***B41J 2/17*** | (2006.01) |
| ***B41J 3/60*** | (2006.01) |
| ***B41J 29/02*** | (2006.01) |

(52) U.S. Cl.
CPC ..... *B41J 13/0045* (2013.01); *B41J 2/1721* (2013.01); *B41J 3/60* (2013.01); *B41J 29/02* (2013.01); *B41J 2002/1728* (2013.01)

(58) Field of Classification Search
CPC ..... B41J 13/0045; B41J 2/1721; B41J 2002/1728; B41J 3/60; B41J 29/02
See application file for complete search history.

(56) References Cited

U.S. PATENT DOCUMENTS

| | | | | |
|---|---|---|---|---|
| 6,785,508 | B2 | 8/2004 | Jeong | |
| 7,649,648 | B2 | 1/2010 | Lapstun et al. | |
| 2004/0056919 | A1 | 3/2004 | Gaston et al. | |
| 2007/0052151 | A1 | 3/2007 | Asaba | |
| 2007/0237541 | A1 | 10/2007 | Johnson et al. | |
| 2012/0092430 | A1* | 4/2012 | Yearout | B41J 3/60 347/104 |
| 2012/0306978 | A1 | 12/2012 | Chuang et al. | |
| 2013/0050372 | A1* | 2/2013 | Lo | B41J 11/006 347/104 |
| 2014/0033832 | A1 | 2/2014 | Huang et al. | |
| 2014/0204164 | A1 | 7/2014 | Coffin et al. | |
| 2015/0070418 | A1 | 3/2015 | MacClary et al. | |
| 2015/0266314 | A1 | 9/2015 | Toia et al. | |

* cited by examiner

*Primary Examiner* — Matthew Luu
*Assistant Examiner* — Kendrick X Liu
(74) *Attorney, Agent, or Firm* — Fabian VanCott

(57) ABSTRACT

In one example in accordance with the present disclosure a print duplexing assembly is described. The assembly includes a duplexing device to facilitate printing on both sides of a print media. The assembly also includes a platen coupled to the duplexing device to guide the print media along a feed path as it is being printed on. The platen and the duplexing device are selectively removable from a printing device in which they are installed.

20 Claims, 10 Drawing Sheets

PRINT DUPLEXING ASSEMBLY WITH REMOVABLE DUPLEXING DEVICE

BACKGROUND

Printing devices are used in many personal and commercial endeavors. In a printing device, a print media is moved through the device and a printing fluid such as ink is deposited on the print media to form text and/or images. Some printing devices are capable of printing on both sides of a print media, in an operation referred to as duplexing. In a duplexing operation, printing fluid is deposited on one side of the print media, the print media is flipped over, and printing fluid is deposited on the other side of the print media.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
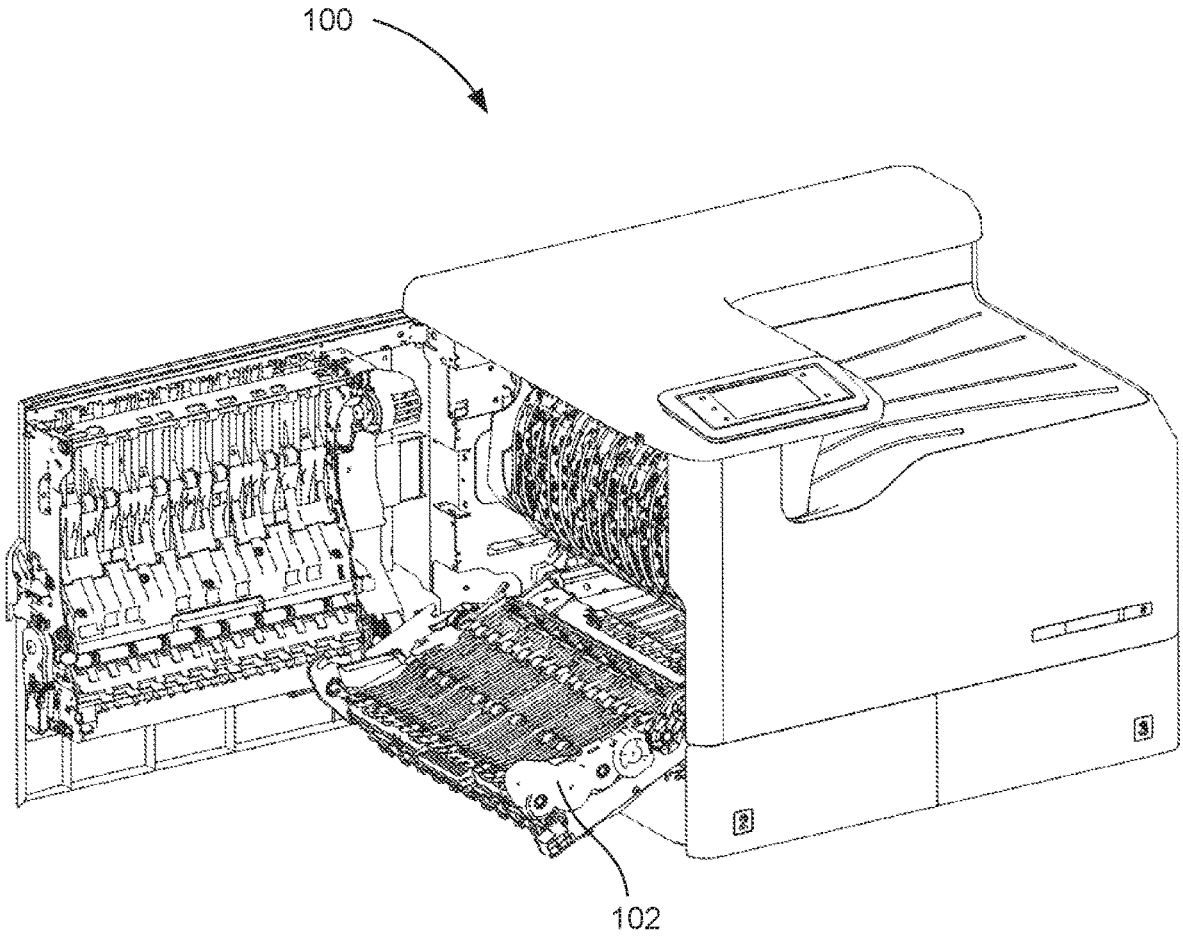
FIG. 1 is a diagram of a removable print duplexing assembly as inserted into a printing device, according to one example of the principles described herein.

Printing device are becoming ubiquitous in society. As printing devices are becoming more commonplace, printing device functionality is also on the rise. For example, many small office and residential printing devices support duplex printing that allows for depositing a printing fluid, such as ink, onto both sides of a print media. In performing duplexing, the printing fluid is deposited on one surface of the print media, the print media is then flipped over, and a printing fluid is deposited on the other side of the print media. These printing devices also include other components such as a platen which supports the print media as it passes under the print zone. The print zone being defined as the area of the printing device where ink, or other printing fluid, is deposited onto the print media. For example, the platen may be on one side of the print media opposite the print bar that deposits fluid on the print media. The platen provides a mechanical support for the print media as it is printed on and also facilitates the movement and guidance of the print media through at least the print zone portion of the printing device.

While printing devices have grown in their operational capacity, some characteristics impact their usefulness. For example, over time dust, ink deposits, and other debris builds up on the platen and may reduce print quality, for example by causing smearing on the back side of the print media. Moreover, during cleaning operations, ink is spit through the nozzles of the print bar to clean the nozzles. The excess ink from such a cleaning operation may be in droplet form or aerosolized droplets, meaning that the droplets are so small they are lighter than air. Such droplets similarly can impact the print quality, and therefore customer satisfaction.

Accordingly, the present specification describes a print duplexing assembly that addresses these and other issues. More specifically, in one example, the present specification describes a removable print duplexing assembly that includes a duplexing device to facilitate printing on both sides of a print media. The print duplexing assembly also includes a platen coupled to the duplexing device. The platen guides the print media as it is being printed on. Both the platen and duplexing device are selectively removable from a printing device on which they are inserted.

Still further, the present specification describes a print duplexing assembly that includes a service fluid container. The service fluid container includes a bucket and a lid that join together. The service fluid container catches excess fluid ejected from a print bar. The print duplexing assembly also includes a duplexing device to facilitate printing on both sides of a print media. The service fluid container is disposed within the duplexing device. The duplexing device and the corresponding service fluid container are selectively removable from a printing device in which they are inserted.

Even further, the present specification describes a print duplexing assembly that includes a duplexing device to facilitate printing on both sides of a print media. A non-volatile memory device is disposed on the duplexing device to store information. The duplexing device is selectively removable from a printing device on which it is inserted.

Using a removable print duplexing assembly as described herein 1) allows for the replacement of a platen along with the duplexing device of the duplexing assembly; 2) allows for the simultaneous replacement of a duplexing device and an aerosol filter; 3) stores information relating to the duplexing device directly on the duplexing device; 4) secures the duplexing device to the printing device so as to prevent user injury or damage to the duplexing device upon removal of a paper jam; and 5) offers increased accessibility to the interior of the printing device for example when removing a paper jam. However, it is contemplated that the devices disclosed herein may provide useful in addressing other matters and deficiencies in a number of technical areas. Therefore the systems and methods disclosed herein should not be construed as addressing any of the particular matters.

As used in the present specification and in the appended claims, the term "a number of" or similar language is meant to be understood broadly as any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language indicates that a particular feature, structure, or characteristic described in connection with that example is included as described, but may not be included in other examples.

Turning now to the figures, FIG. 1 is a diagram of a removable print duplexing assembly (102) as inserted into a printing device (100), according to one example of the principles described herein. The printing device (100) may be any type of printing device (100) including a laser printing device or an inkjet printing device. A printing device (100) deposits a printing fluid on a print media. For example, print media is stored in a tray. Upon a command from a user, the print media follows a feed path wherein the print media is moved into a print zone, where the printing fluid is deposited on to the print media by a print bar.

To deposit the printing fluid onto the print media, a print bar may include a number of components. For example, the print bar may include a number of firing cells. A firing cell may include an ejector, a firing chamber, and a nozzle. The nozzle may allow fluid, such as ink, to be deposited onto a surface, such as a print medium. The firing chamber may include a small amount of fluid. The ejector may be a mechanism for ejecting fluid through an opening from a firing chamber, where the ejector may include a firing resistor or other thermal device, a piezoelectric element, or other mechanism for ejecting fluid from the firing chamber.

For example, the ejector may be a firing resistor. The firing resistor heats up in response to an applied voltage. As the firing resistor heats up, a portion of the fluid in the firing chamber vaporizes to form a bubble. This bubble pushes liquid fluid out the nozzle and onto the print medium. As the vaporized fluid bubble pops, a vacuum pressure within the firing chamber draws fluid into the firing chamber from the fluid supply, and the process repeats. In this example, the print bar may be a thermal inkjet print bar.

In another example, the ejector may be a piezoelectric device. As a voltage is applied, the piezoelectric device changes shape which generates a pressure pulse in the firing chamber that pushes a fluid out the nozzle and onto the print medium. In this example, the print bar may be a piezoelectric inkjet print bar.

The removable print duplexing assembly (102) is insertable into the printing device (100). The removable print duplexing assembly (102) contains various components, including a duplexing device and a platen that perform various functions. For example, the platen of the print duplexing assembly supports the paper in the print zone as the print bar ejects ink onto the paper. The duplexing device is a component of the removable print duplexing assembly (102) that feeds and guides the print media from the output zone, i.e., after it has been printed on one side, and returns the print media to the print zone so that the other size of the printing media can be printed on.

In addition to this functionality, the removable print duplexing assembly (102) also captures service fluid. There are at least two types of service fluid, shipping fluid and ink. Shipping fluid may include glycerol, water, and dye colorant (no pigments). New print bars are filled with shipping fluid to prevent the fluids in the print bar from drying out and to prevent pigments from settling down to the bottom of the print bar and potentially clogging the nozzles. Because shipping fluid has glycerol and no pigment, printing with shipping fluid results in very poor print quality. Accordingly, prior to use the shipping fluid is ejected from the print bar and replaced with printing fluid such as ink before customers start using the printing device (100). Accordingly, the print bar ejects the shipping fluid through the openings in the platen and into a service fluid container inside the removable print duplexing assembly (102). An example of the fluid service container is depicted below in FIG. 5.

The second type of service fluid is ink. Once all the shipping fluid is replaced with ink, the print bar periodically ejects ink out the nozzles before, between, and after printed pages in order to prevent the nozzles from clogging up. This ink is also ejected through the openings in the platen and into the service fluid container inside the removable print duplexing assembly (102).

The removable print duplexing assembly (102) also includes a paper output system. The paper output system moves and guides the print media to an output bin. Previously, such paper output systems have been integral to the printing device (100), and not a component of a removable, or modular, removable print duplexing assembly (102).

In this example, the removable print duplexing assembly (102) is selectively removable from the printing device (100). More specifically, the duplexing device and the platen are both simultaneously selectively removable from the printing device (100) in which they are inserted. In previous systems, the platen may not have been removable, much less simultaneously removable with the duplexing device. Doing so allows for the platen to be periodically replaced along with the duplexing device. For example, as described above, over time, dust, ink depositions, and other debris build up on the platen potentially reducing the print quality. Accordingly, by allowing for a selectively removable, or modular, platen, the undesirable consequences of long use are alleviated as the platen is removable and replaceable, along with the duplexing device, which new platen is free of debris and dust.

Figure 2A:
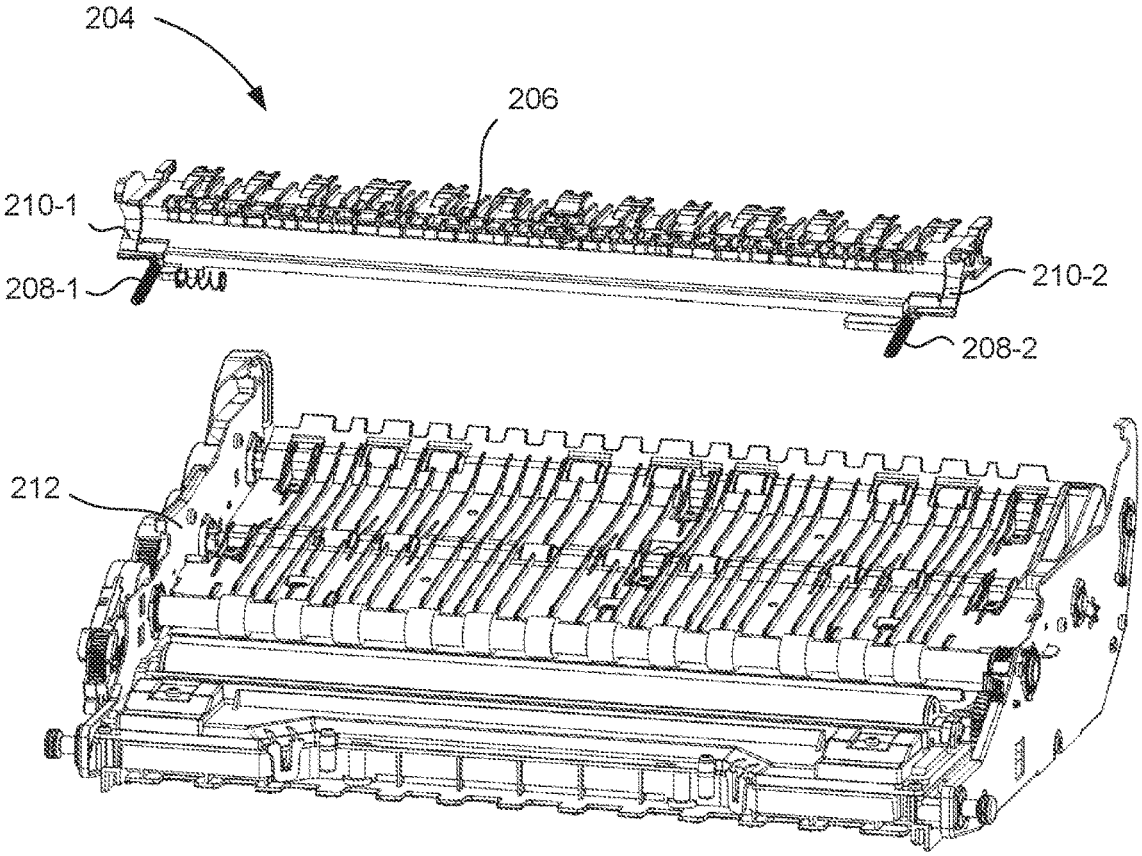
FIGS. 2A and 2B are views of a removable print duplexing assembly that includes a duplexing device and a platen, according to one example of the principles described herein.
Figure 2B:
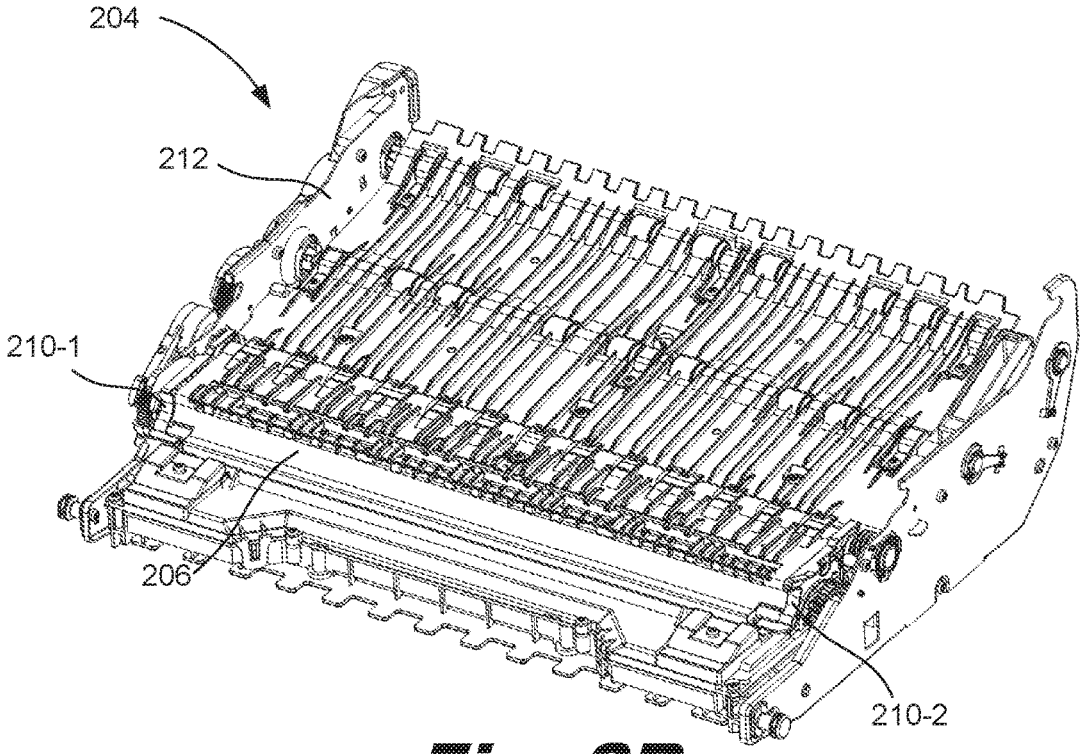

FIGS. 2A and 2B are views of a removable print duplexing assembly (204) that includes a duplexing device (212) and a platen (206), according to one example of the principles described herein. Specifically, FIG. 2A is an exploded view of the removable print duplexing assembly (204), and FIG. 2B is an assembled view of the removable print duplexing assembly (204). In some examples, the removable print duplexing assembly (204) may be insertable into a printing device (FIG. 1, 100) as described above in connection with FIG. 1.

As described above, the removable print duplexing assembly (204), and specifically the duplexing device (212) and the platen (206) are selectively removable from the printing device (FIG. 1, 100). In some examples, the duplexing device (212) and the platen (206) are simultaneously selectively removable. For example, the platen (206) is coupled to the duplexing device (212) and accordingly, as the duplexing device (212) is removed, the platen (206) is also removed.

The duplexing device (212) and the platen (206) may be joined using any number of mechanisms. For example, the platen (206) and the duplexing device (212) may be mechanically joined using fasteners, rods, screws, and slots, among other joining devices. Joining the duplexing device (212) and the platen (206) allows for clean, debris-free platens (206) to be used in the printing device (FIG. 1, 100), and replaced along with the duplexing device (212). For example, in other printing devices, a platen has been integral to the printing device (FIG. 1, 100). However, as described above the platen (206) collects debris over time. If the platen (206) is not removable, the print quality is effected and cleaning of a platen integral to the printing device (FIG. 1, 100) may be very difficult, if possible. Accordingly, a removable platen (206) improves print quality by periodically allowing for the removal of an older, dirty or otherwise worn down platen (206) with a new, clean platen (206).

In some examples, the duplexing device (212) includes an aerosol filter disposed therein. The aerosol filter catches excess aerosolized fluid droplets ejected through nozzles of the print bar. An example of the duplexing device (212) with an aerosol filter disposed therein is provided below in connection with FIG. 5.

Still further, in some examples the removable print duplexing assembly (204) includes a non-volatile memory device disposed on the duplexing device (212). The non-volatile memory device includes information relating to the duplexing device or other pertinent information of the removable print duplexing assembly (204). An example of the removable print duplexing assembly (204) with a non-volatile memory device disposed thereon is provided below in connection with FIG. 6.

While the platen (206) is coupled to the duplexing device (212), the platen (206) may move independently from the duplexing device (212). For example, the platen (206) may include springs (208-1, 208-2) that exert a force against the duplexing device (212) when the two are coupled together. The springs (208-1, 208-2) bias the platen (206) against a feed shaft and allow the platen (206) to float, or move independently from the duplexing device (212).

Figure 3A:
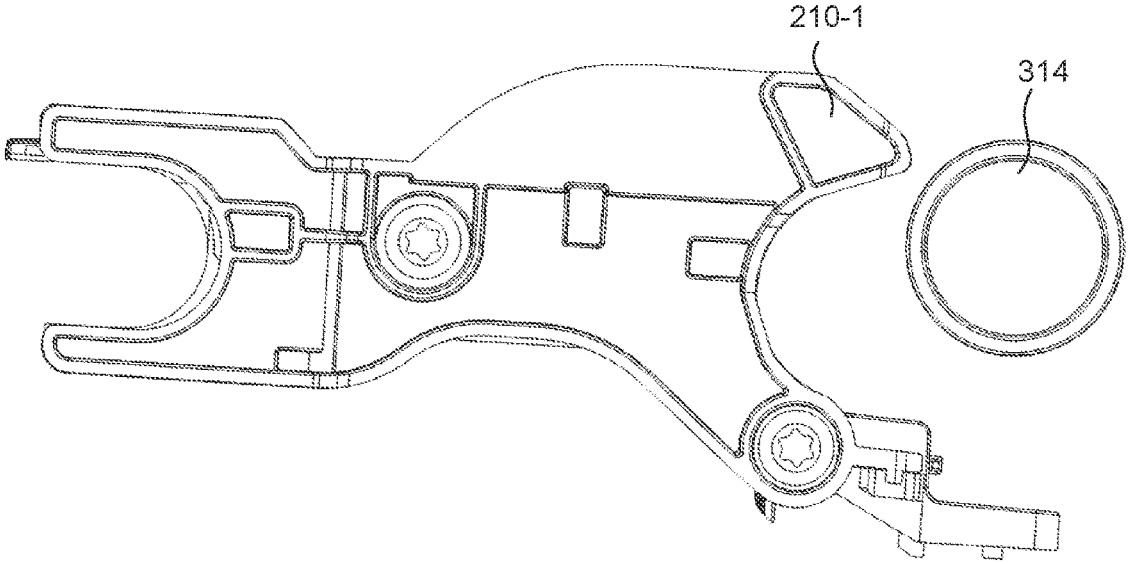
FIGS. 3A and 3B are blown up diagrams of a bearing that allows for independent motion of the duplexing device and the platen, according to one example of the principles described herein.
Figure 3B:
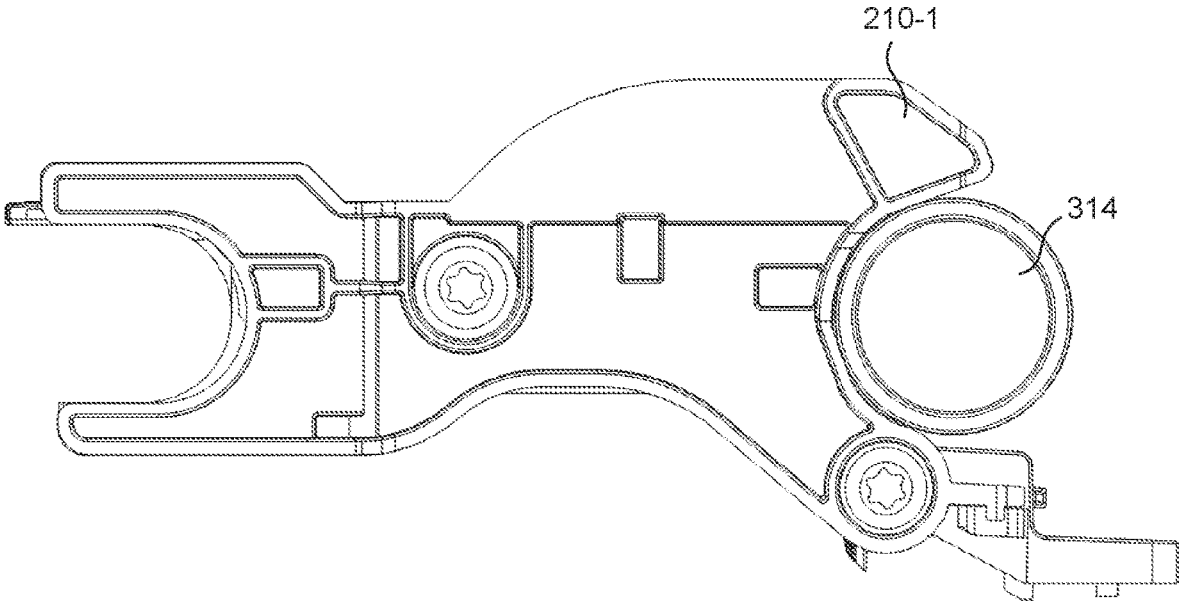

In some examples, the platen (206) datums to the feed shaft. For example, where the platen (206) abuts the feed shaft, bearings (210-1, 210-2) align the platen (206) against the feedshaft. FIGS. 3A and 3B are blown up diagram of one bearing (210-1) that positions the platen (206) relative to the feedshaft (314) and the duplexing device (FIG. 2, 212), according to one example of the principles described herein. Specifically, FIG. 3A depicts the bearing (210-1) and the feed shaft (314) before the installation of the platen (FIG. 2, 206) and FIG. 3B depicts the bearing (210-1) and the feed shaft (314) after the installation of the platen (FIG. 2, 206). Accordingly, when the removable print duplex assembly (FIG. 2, 204) is installed into the printing device (FIG. 1, 100), bearings (210) on the front and rear of the platen (FIG. 2, 206) align the platen (FIG. 2, 206) directly to a print feed shaft (314). Doing so drastically shortens the tolerance loop between the platen (206) and the print bar.

FIG. 4A-4E illustrate the retention and removal of the removable print duplexing assembly (416) from the printing device (FIG. 1, 100), according to one example of the principles described herein. The removable print duplexing assembly (416) depicted in FIGS. 4A-4E may be similar to the removable print duplexing assemblies described above.

As described above, in some examples, the removable print duplexing assembly (416) is selectively removable from the printing device (FIG. 1, 100) in which it is inserted. To accomplish this removal, the removable print duplexing assembly (416) may include a number of retention devices (420). The retention devices (420) are clearly visible in FIGS. 4D and 4E. In some examples the retention devices (420) are protrusions, or wheels that interact with rails (418-1, 418-2) of the printing device (FIG. 1, 100). The retention devices (420) allow the removable print duplexing assembly (416) to be slid out from an interior of the printing device (FIG. 1, 100) while retaining the removable print duplexing assembly (416) to the printing device (FIG. 1, 100). In so doing, a user can move the removable print duplexing assembly (416) out of the way when access to the interior of the printing device (FIG. 1, 100) is desired. For example, during a paper jam, without a removable duplexing device (FIG. 1, 100) that includes the platen (FIG. 2, 206), a "dead zone" exists wherein a user could not reach to withdraw jammed paper. Via the retention devices (420) a user can slide the removable print duplexing assembly (416) outside of the body of the printing device (FIG. 1, 100) to access the interior paper jam, all while still retaining the removable print duplexing assembly (416) to the printing device (FIG. 1, 100). Retaining the removable print duplexing assembly (416) to the printing device (FIG. 1, 100) allows for the weight of the removable print duplexing assembly (416) to be supported by the printing device (FIG. 1, 100) rather than the user.

Figure 4A:
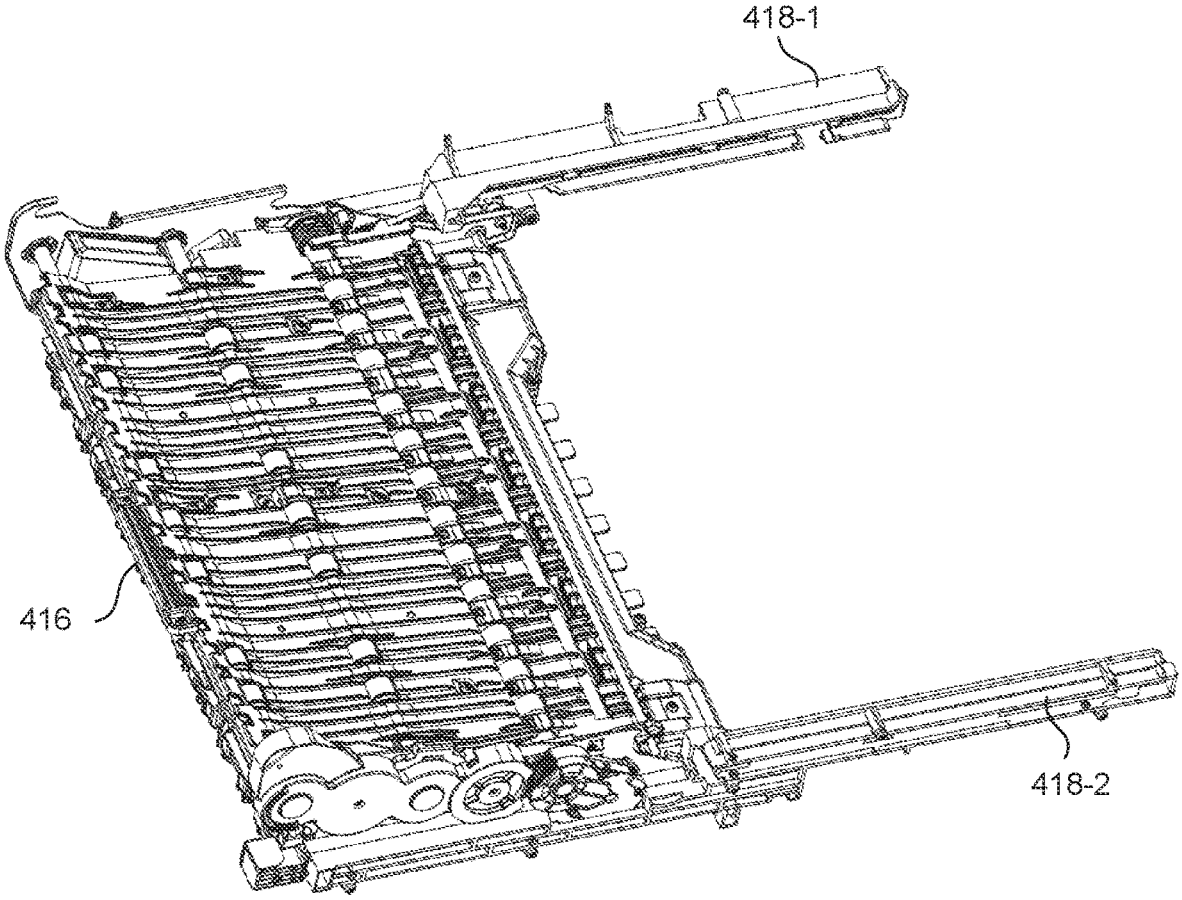
FIG. 4A-4E illustrate the retention and removal of the removable print duplexing assembly from the printing device, according to one example of the principles described herein.
Figure 4B:
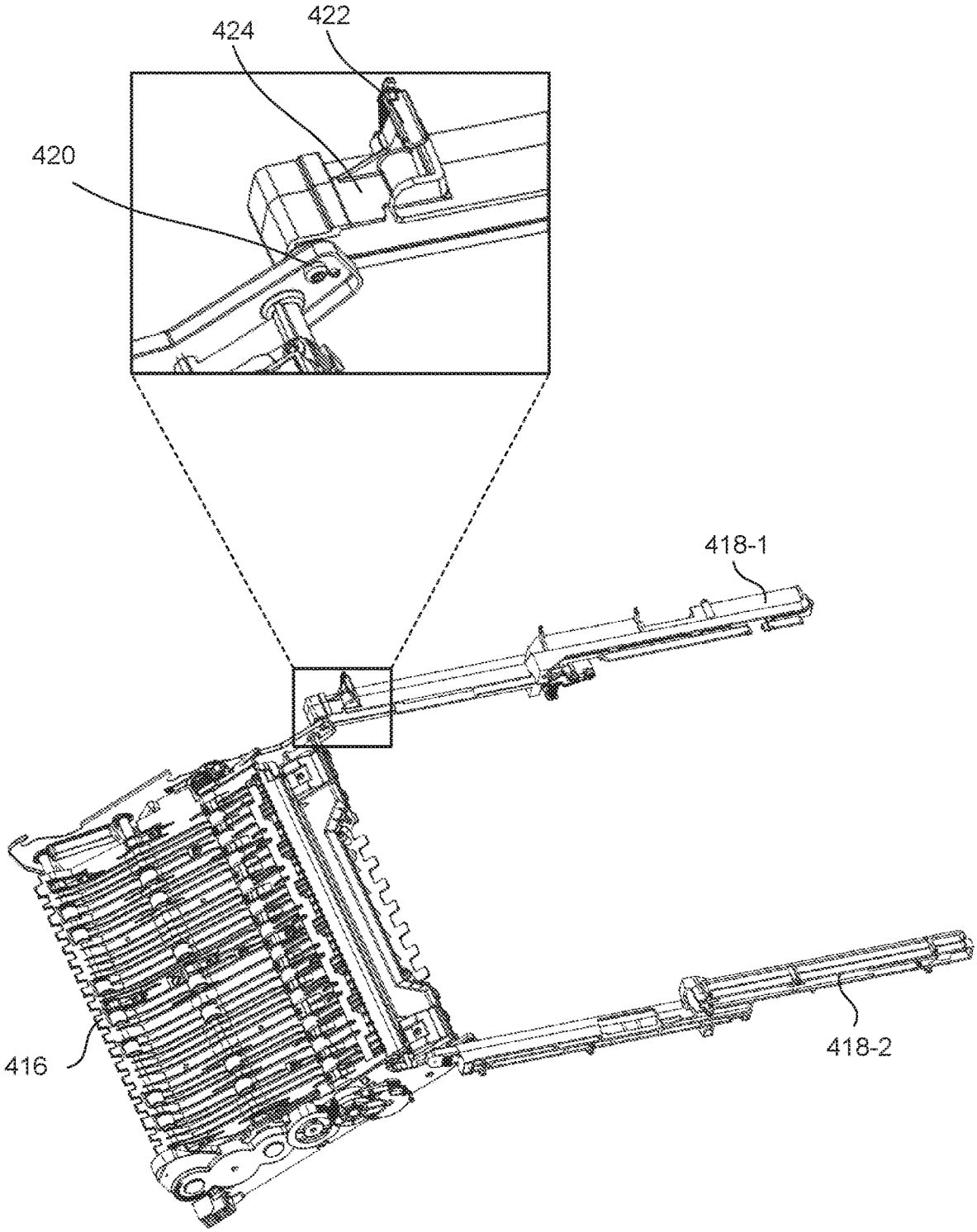

The retention devices (420) also facilitate the removal of the removable print duplexing assembly (416) from the printing device (FIG. 1, 100). FIG. 4A depicts the removable print duplexing assembly (416) fully extended along the rails (418-1, 418-2) of the printing device (FIG. 1, 100). As can be seen in FIG. 4B, the end of the rails (418) interface with the retention devices (420) to prevent the removable print duplexing assembly (416) from being fully separated from the printing device (FIG. 1, 100). After fully extending, the user can then pivot the removable print duplexing assembly (416) down and out of the way, thus further exposing the interior of the printing device (FIG. 1, 100).

Figure 4C:
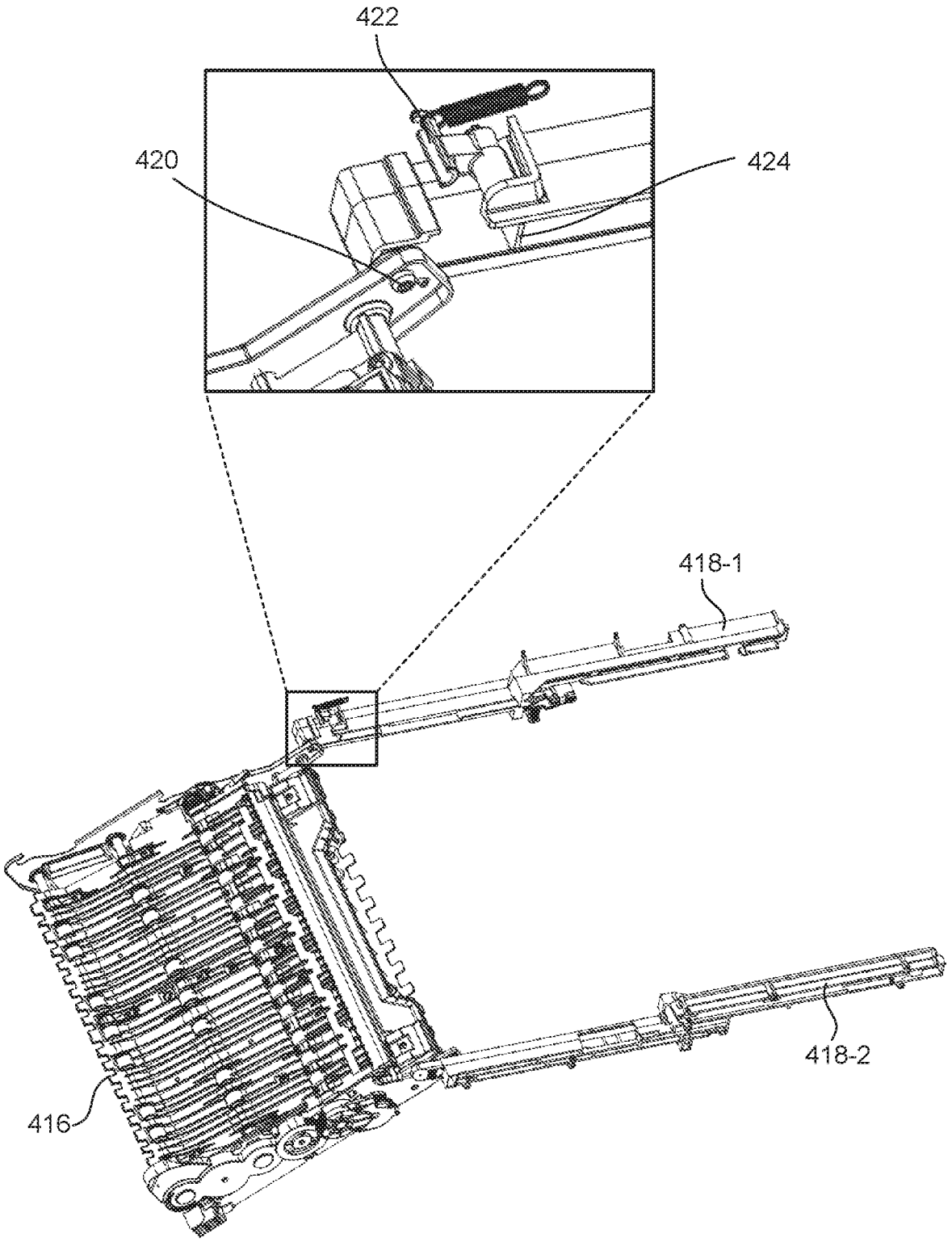
Figure 4D:
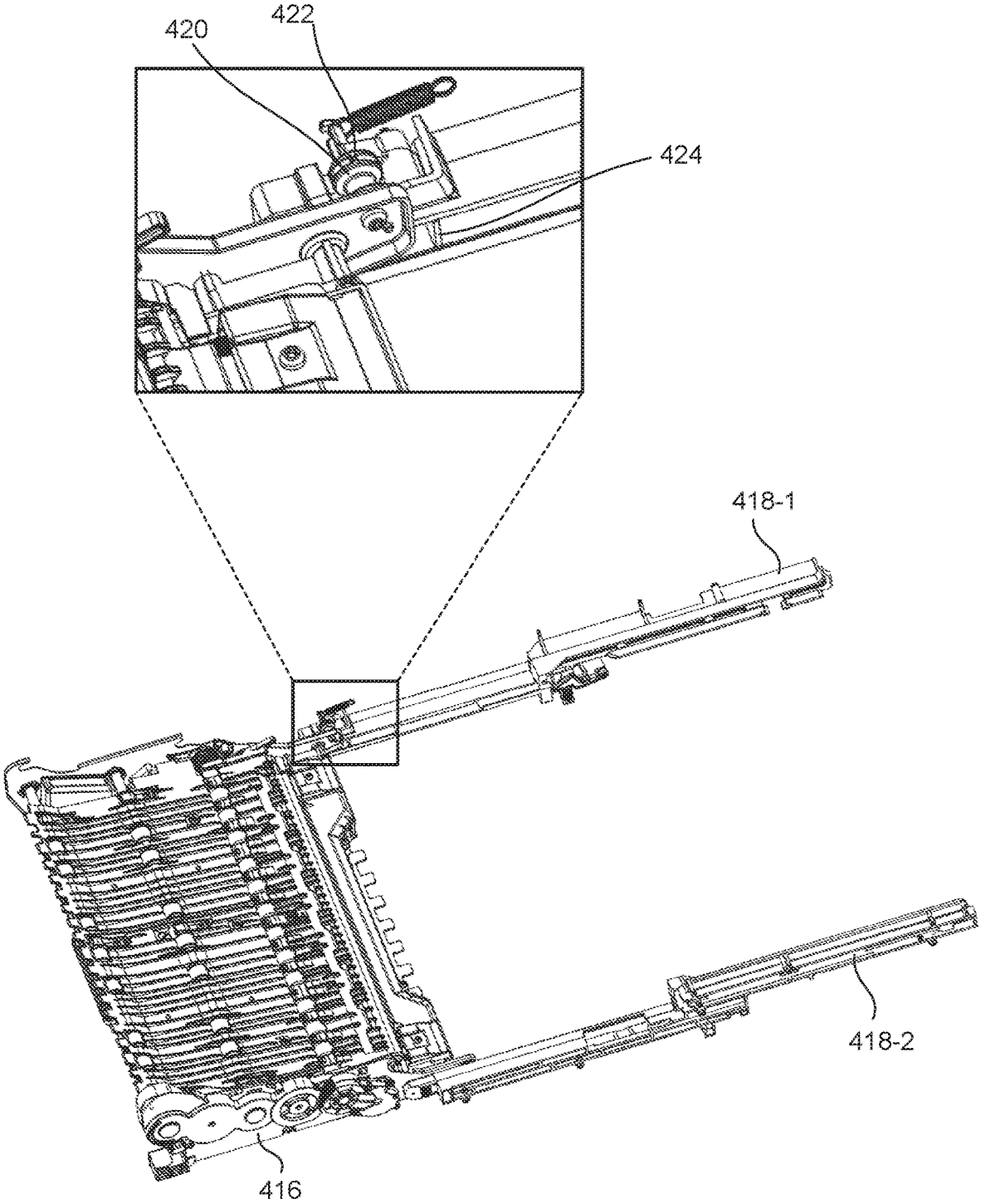
Figure 4E:
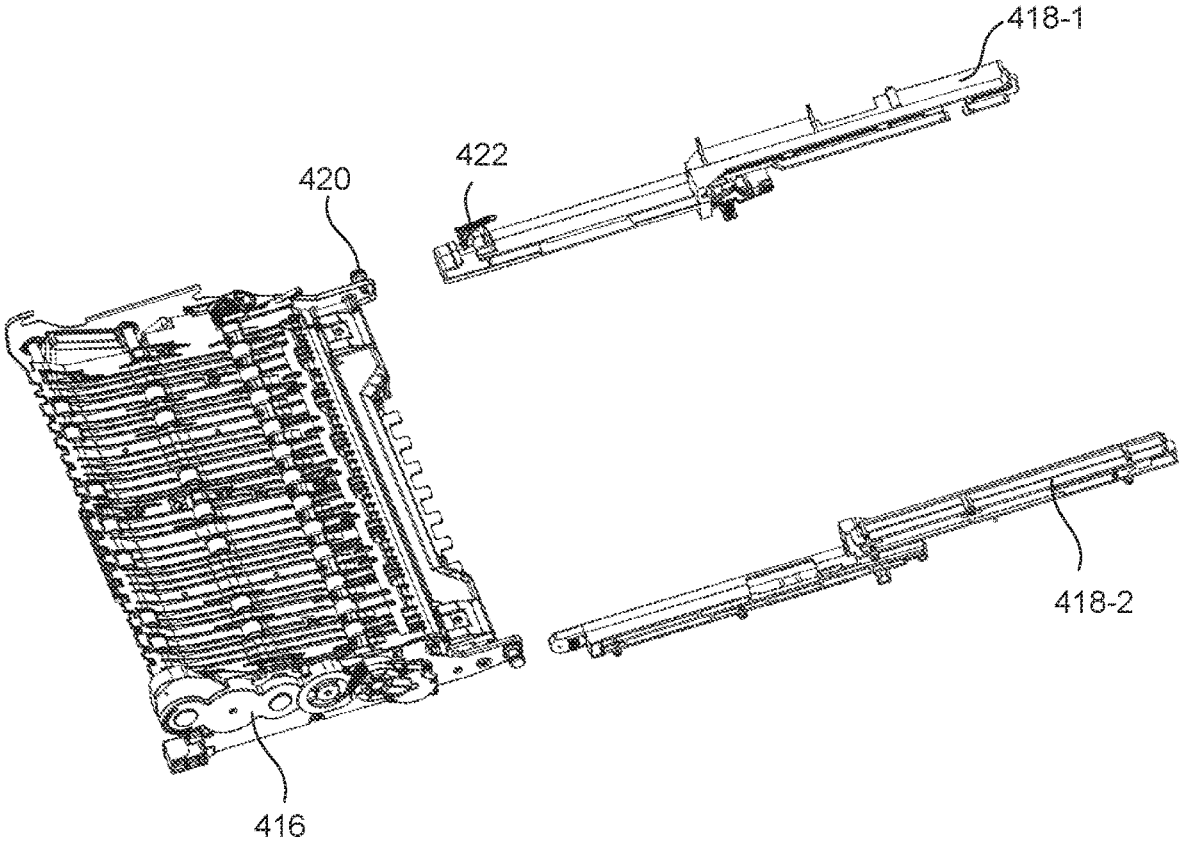

To fully remove the removable print duplexing assembly (416), a spring-loaded latch (422) is activated as depicted in FIG. 4C. The spring-loaded latch (422) is mechanically coupled to a door (424) that opens a slot through which the retention device (420) can pass. In some examples, less than all of the rails (418) have the spring-loaded latch (422) and door (424). For example, just one rail (418-1) may have such a feature. The removable print duplexing assembly (416) can then be moved to align with the slot as depicted in FIG. 4D. Then, the removable print duplexing assembly (416) is lifted such that the retention devices (420) are removed from within the rails (418) as depicted in FIG. 4E. The removable print duplexing assembly (416), along with the duplexing device (FIG. 2, 212) and the platen (FIG. 2, 206) are fully removed from the printing device (FIG. 1, 100).

The modular nature, i.e., the use of the retention features (420), latch (422), and rail (418) together, facilitate the easy removal of not only the duplexing device (FIG. 2, 212) which facilitates duplex printing, but also the platen (FIG. 2, 206) which supports the print media, which platen (FIG. 2, 206) would otherwise be integral to the printing device (FIG. 1, 100). Thus, according to the present specification, any print quality defects resulting from an overused platen is alleviated as an old platen (FIG. 2, 206) can easily be inserted into the printing device (FIG. 1, 100) as part of a new removable print duplexing assembly (416).

Moreover, the ability to slide the removable print duplexing assembly (416) out from the interior of the printing device (FIG. 1, 100) allows for greater access to the inside of the printing device (FIG. 1, 100), for example, when attempting to remove jammed print media. Moreover, the retention devices (420) positively retain the removable print duplexing assembly (416) to the printing device (FIG. 1, 100). As the weight of the removable print duplexing assembly (416) is retained by the printing device (FIG. 1, 100) via the retention devices (420) and the rails (418), the weight is not retained by the user. Thus, there is less likelihood of dropping and damaging the removable print duplexing assembly (416) as well as potentially injuring an individual servicing the printing device (FIG. 1, 100).

Figure 5:
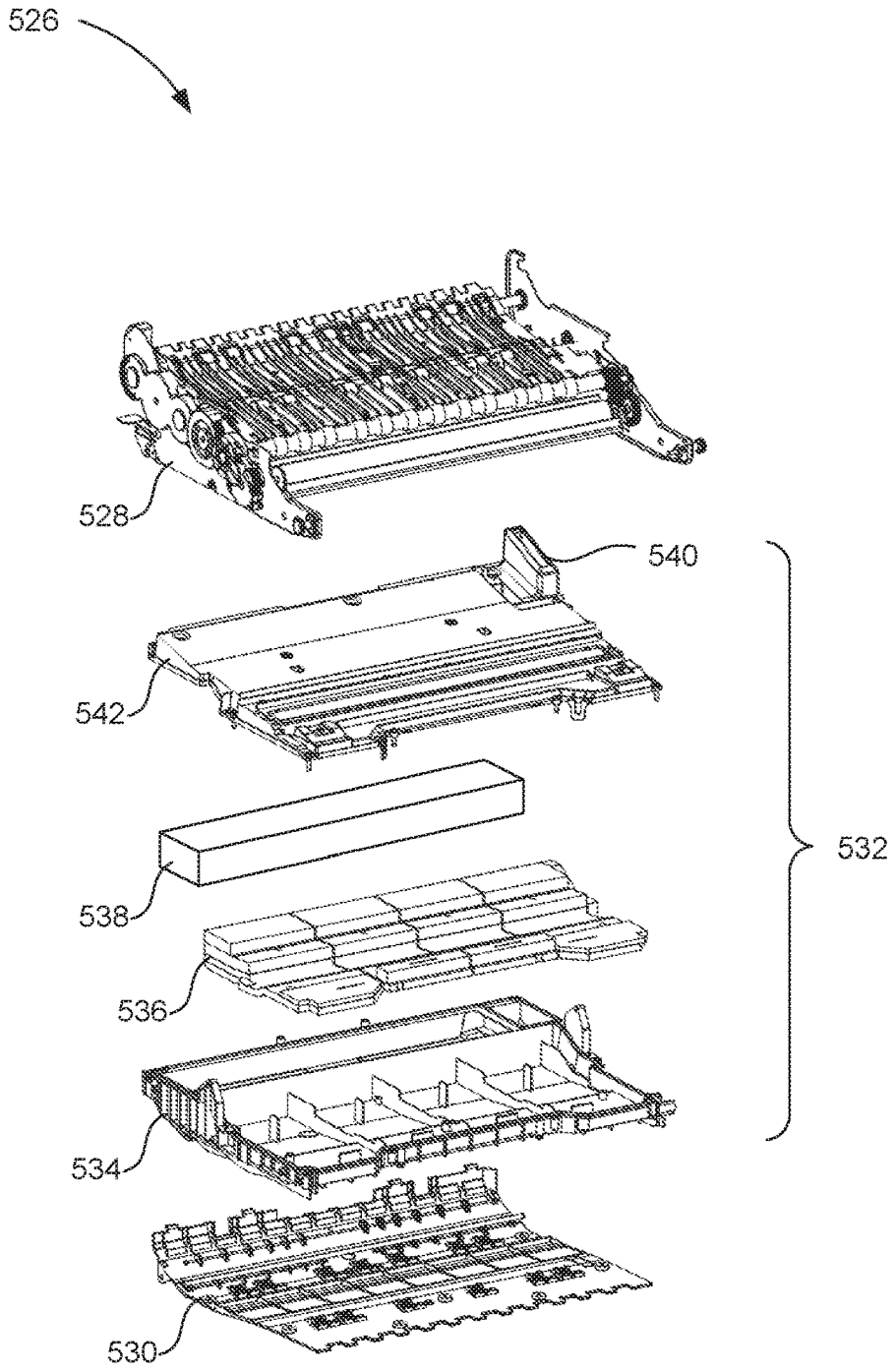
FIG. 5 is an exploded view of a removable print duplexing assembly, according to another example of the principles described herein.

FIG. 5 is an exploded view of a removable print duplexing assembly (FIG. 1, 102), according to another example of the principles described herein. Specifically, the removable print duplexing assembly (FIG. 1, 102) includes a duplexing device (526). The duplexing device (526) includes a bucket (534) and a lid (542) that join together to form a service fluid container (532). The service fluid container (532) forms the inner core of the removable print duplexing assembly (FIG. 1, 102) and is contained within a duplexing device (526). Specifically, a first portion (528) and a second portion (530) of the duplexing device (526), which portions include external components of the duplexing device (526), are attached to the service fluid container (532). The service fluid container (532) catches excess fluid flowing through the printing device (FIG. 1, 100). For example, as described above, prior to use, shipping fluid that is included with the print bar upon shipment is purged. This purging results in the shipping fluid being contained in the service fluid container (532). Moreover, during printing, ink, or another printing fluid is periodically spit through the nozzles to prevent them from clogging up. This ink or other printing fluid is also captured by the service fluid container (532).

During these operations, the service fluid, i.e., the shipping fluid or ink, breaks up into multiple droplets of varying size. The larger droplets are captured by a number of fluid absorption devices (536) and retained therein. Some of the droplets are so small that they are lighter than air. Such droplets may be referred to as aerosolized fluid droplets. As they are lighter than air, these aerosolized droplets float in the air and are dispersed by air currents. Such droplets, if deposited on the print media, could ultimately affect print quality and if deposited within the printing device (FIG. 1, 100) potentially affect the functionality of the printing device (FIG. 1, 100). For example, the aerosolized droplets could collect on the lens of optical sensors making them inoperable. Accordingly, the service fluid container (532) includes an aerosol filter (538) to retain these aerosolized fluid droplets.

Specifically, the printing device (FIG. 1, 100) may have an aerosol fan, or other component, for directing the aerosolized fluid droplets. A chimney (540) on the lid (542) of the service fluid container (532) is in fluid communication with the aerosol fan and receives the resultant air flow. This air flow is passed through the lid (542) and the aerosolized fluid droplets are captured by the air flow and retained in the aerosol filter (538).

As the aerosol filter (538), and the service fluid container (532) in general, are disposed within the duplexing device (526) of the removable print duplexing assembly (FIG. 1, 102), the aerosol filter (538) is removable along with the duplexing device (526). This is helpful as the aerosol filter (538) may be replaced along with the duplexing device (526) instead of being independently replaced. Doing so simplifies the overall component replacement as a user replaces one component, the duplexing device (526) with the inserted aerosol filter (538), instead of replacing the two components separately. This simple replacement could increase product life as well as increase customer satisfaction due at least in part to an enhanced product performance.

In some examples, the bucket (534) and lid (542) are sealed together to be water tight. For example, the bucket (534) may be glued to the lid (542). Doing so prevents any free fluid within the service fluid container (532) from spilling out.

The duplexing device (526) depicted herein may be coupled with a platen (FIG. 2, 206) as described above in FIG. 2 to be simultaneously selectively removable from the printing device (FIG. 1, 100).

Still further, in some examples the duplexing device (526) includes a non-volatile memory device disposed thereon. The non-volatile memory device includes information relating to the duplexing device (526) or other pertinent information of the removable print duplexing assembly (FIG. 1, 102). An example of the print duplexing assembly with a non-volatile memory device disposed thereon is provided below in connection with FIG. 6.

Figure 6:
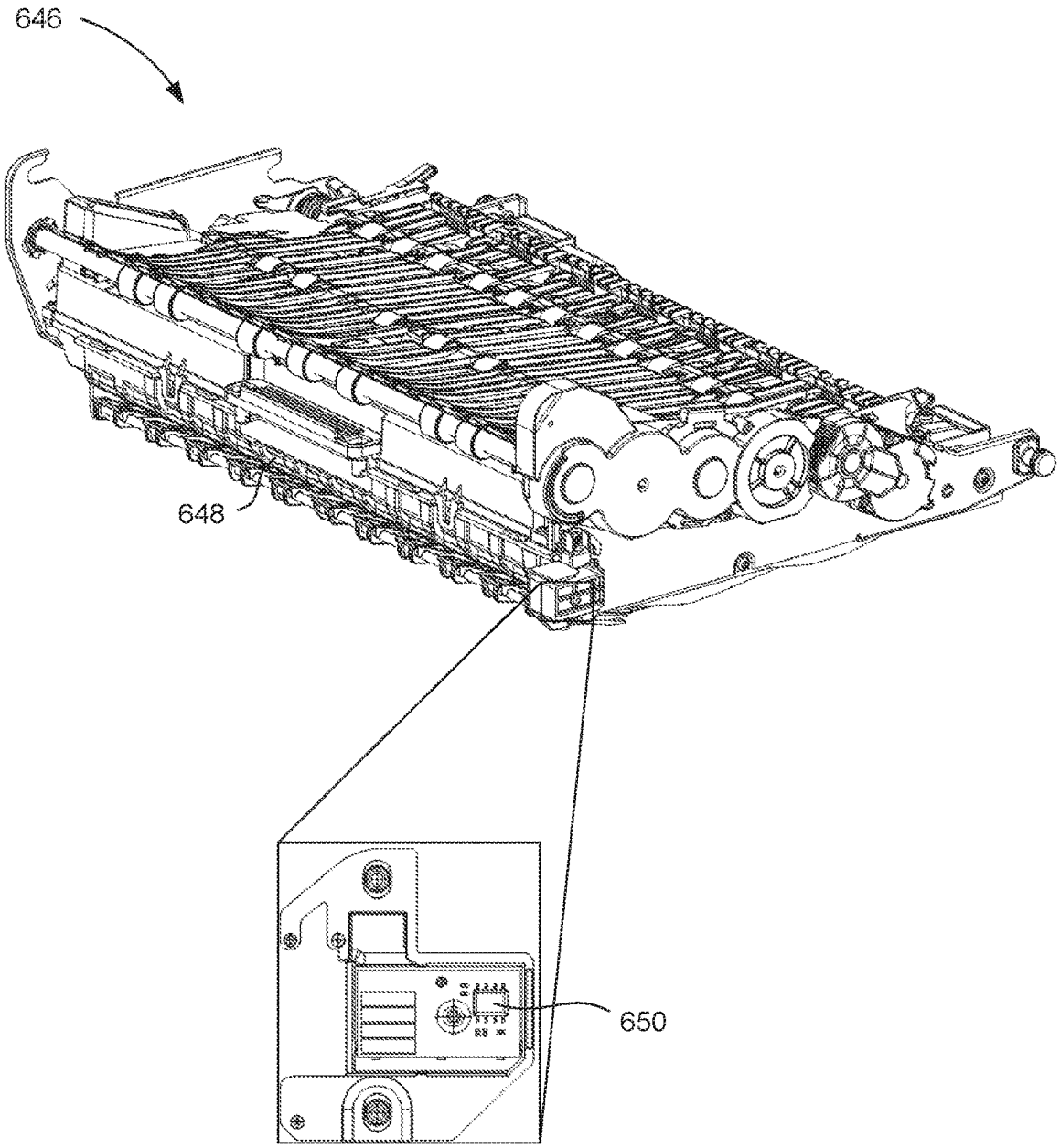
FIG. 6 is a diagram of a removable print duplexing assembly with a non-volatile memory device disposed thereon, according to one example of the principles described herein.

FIG. 6 is a diagram of a removable print duplexing assembly (646) with a non-volatile memory (650) disposed thereon, according to one example of the principles described herein. The removable print duplexing assembly (646) may include a duplexing device (648) similar to those described above. The removable print duplexing assembly (646) also includes a non-volatile memory device (650) disposed on the duplexing device (648). The non-volatile memory device (650) stores information pertinent to the printing operation. For example, the non-volatile memory device (650) may store information relating to the use of the duplexing device (648).

As a specific example, the non-volatile memory device (650) can keep track of the number of shipping fluid purge events that the removable print duplexing assembly (646) has experienced as well as the total amount of service fluid (i.e., shipping fluid or ink) that is currently present in the removable print duplexing assembly (646) so that a consumer may know when a new removable print duplexing assembly (646) is to be installed.

For example, as described above, when a new print bar is shipped, shipping fluid is included therein. Prior to printing, this shipping fluid is purged from the print bar and captured within the duplexing device (648). The duplexing device (648) may have capacity for one such purging event. Accordingly, if the duplexing device (648), as it is removable from a printing device (FIG. 1, 100), is removed and set into another printing device (FIG. 1, 100), i.e., with a new print bar, the duplexing device (648) may be subjected to a second purging event of the new print bar. A second purging event would overwhelm the capacity of the duplexing device (648), thus resulting in spilled fluid which would lead to customer dissatisfaction as well as potential damage to components of the device. Accordingly, having a non-volatile memory device (650) stored on the duplexing device (648) that includes information specific to that duplexing device (648) may prevent more than a predetermined amount, i.e. one, purging event. More specifically, a bit of data could indicate that the duplexing device (648) has already been subject to a purging event. This information could be read by a component of the printing device (FIG. 1, 100) and a subsequent purging event could be halted.

As another example, the non-volatile memory device (650) may indicate when the removable print duplexing assembly (646) is full of fluid and should be replaced. This may be done by tracking the total amount of service fluid in a container of the removable print duplexing assembly (646). More specifically, each time service fluid such as ink or a shipping fluid is ejected into the removable print duplexing assembly (646), the amount may be recorded on the non-volatile memory device (650). While specific examples have been provided of information stored in the non-volatile memory device (65) any information may be stored thereon.

Having the non-volatile memory device (650) on the removable print duplexing assembly (646) addresses the modularity of the removable print duplexing assembly (646) while providing more efficient information. For example, instead of storing such information on a printing device (FIG. 1, 100), the removable print duplexing assembly (646) with the non-volatile memory device (650) disposed thereon can simply be read by a printing device, thus simplifying the acquisition of information. Moreover, without the non-volatile memory device (650) on the removable print duplexing assembly (646), a printing device (FIG. 1, 100)

may have to keep track of how much printing fluid is ejected from a print bar to determine whether the removable print duplexing assembly (646) is full. However, in such a system, the printing device (FIG. 1, 100) would not be able to accurately account for replacement of one duplexing assembly with another. In other words, the non-volatile memory device (650) disposed on the removable print duplexing assembly (646) facilitates swapping the removable print duplexing assembly (646) between printing devices (FIG. 1, 100) without losing any associated data. In some examples, the non-volatile memory device (650) is an electrically erasable programmable read-only memory (EEPROM) device that can be read from or written to.

The removable print duplexing assembly (646) may be coupled with a platen (FIG. 2, 206) as described above in FIG. 2 to be simultaneously selectively removable from the printing device (FIG. 1, 100). In some examples, the duplexing device (648) includes an aerosol filter (FIG. 5, 538) disposed therein.

Using a removable duplexing assembly as described herein 1) allows for the replacement of a platen along with the duplexing device of the duplexing assembly; 2) allows for the simultaneous replacement of a duplexing device and an aerosol filter; 3) stores information relating to the duplexing device directly on the duplexing device; 4) secures the duplexing device to the printing device so as to prevent user injury or damage to the duplexing device upon removal of a paper jam; and 5) offers increased accessibility to the interior of the printing device for example when removing a paper jam. However, it is contemplated that the devices disclosed herein may provide useful in addressing other matters and deficiencies in a number of technical areas. Therefore the systems and methods disclosed herein should not be construed as addressing any of the particular matters.

The preceding description has been presented to illustrate and describe examples of the principles described. This description is not intended to be exhaustive or to limit these principles to any precise form disclosed. Many modifications and variations are possible in light of the above teaching.

What is claimed is:

1. A print duplexing assembly comprising:

a duplexing device to facilitate printing on both sides of a print media; and a platen coupled to the duplexing device, the platen to guide the print media as it is being printed on;

wherein the platen and the duplexing device are coupled so as to be selectively removable as a single unit from a printing device in which they are inserted.

2. The print duplexing assembly of claim 1, further comprising an aerosol filter disposed within the duplexing device to catch aerosolized fluid droplets ejected from a print bar.

3. The print duplexing assembly of claim 1, further comprising a non-volatile memory device disposed on the duplexing device to store information.

4. The print duplexing assembly of claim 1, wherein the platen and the duplexing device unit comprises retention devices to interact with rails of the printing device in which they are inserted so that the duplexing device and platen are slidable along the rails into and out of the printing device.

5. The print duplexing assembly of claim 4, wherein the retention devices allow the print duplex assembly to pivot about ends of the rails and comprise a spring-loaded latch for releasing the print duplex assembly from the rails.

6. The print duplexing assembly of claim 1, wherein the platen is mounted to the duplexing device using with springs so that the platen moves independently from the duplexing device while inserted in the printing device.

7. The print duplexing assembly of claim 6, wherein the springs bias the platen against a feed shaft of a printing device, the platen further comprising bearings to align the platen with the feed shaft.

8. The print duplexing assembly of claim 1, further comprising a number of retention devices to:

allow the print duplexing assembly to be slid out from an interior of the printing device, and retained to the printing device; and to interface with a latch on the printing device to facilitate removal of the print duplexing assembly.

9. The print duplexing assembly of claim 1, further comprising fasteners to couple the platen to the duplexing device.

10. A print duplexing assembly comprising:

a service fluid container comprising a bucket and a lid joined together so that the lid covers and seals the bucket to prevent fluid from spilling out of the service fluid container, wherein the service fluid container comprises openings arranged to catch excess fluid ejected from a print bar; and a duplexing device to facilitate printing on both sides of a print media;

wherein:

the service fluid container is disposed on an interior of the duplexing device; and the duplexing device and corresponding service fluid container are selectively removable together as a single unit from a printing device in which they are inserted.

11. The print duplexing assembly of claim 10, wherein the service fluid container comprises:

an aerosol filter to catch aerosolized fluid droplets of printing fluid; and a number of fluid absorption devices to absorb excess printing fluid.

12. The print duplexing assembly of claim 11, further comprising a non-volatile memory device disposed on the duplexing device to store information.

13. The print duplexing assembly of claim 10, further comprising:

a platen joined to the duplexing device, wherein the platen and duplexing device are modular to the printing device in which they are installed.

14. The print duplexing assembly of claim 10, wherein the bucket of the service fluid container is glued to the lid of the service fluid container.

15. The print duplexing assembly of claim 10, wherein the bucket and lid are sealed together with a water-tight seal.

16. The print duplexing assembly of claim 10, wherein the openings extend through the platen to allow fluid ejected from the print bar to move through the platen and into the service fluid container.

17. A print duplexing assembly comprising:

a duplexing device to facilitate printing on both sides of a print media; and a non-volatile memory device disposed on the duplexing device to store information;

wherein the duplexing device is selectively removable from a printing device in which it is inserted.

18. The print duplexing assembly of claim 17, further comprising a platen joined to the duplexing device, wherein the platen and duplexing device are modular to the printing device in which they are installed.

19. The print duplexing assembly of claim 17, wherein the non-volatile memory stores an indication of an amount of fluid stored inside the print duplexing assembly.

20. The print duplexing assembly of claim 17, wherein the non-volatile memory device is an electrically erasable programmable read-only memory (EEPROM) device.

* * * * *